US006224729B1

(12) United States Patent
Castegnier

(10) Patent No.: US 6,224,729 B1
(45) Date of Patent: May 1, 2001

(54) STAINLESS STEEL ANODE FOR ELECTROCOAGULATION PRINTING

(75) Inventor: Adrien Castegnier, Outremont (CA)

(73) Assignee: Elcorsy Technology Inc., Saint-Laurent (CA)

( * ) Notice: Subject to any disclaimer, the term of this patent is extended or adjusted under 35 U.S.C. 154(b) by 0 days.

(21) Appl. No.: 09/430,017

(22) Filed: Oct. 29, 1999

(51) Int. Cl.[7] ..... C25D 13/04

(52) U.S. Cl. ..... 204/486; 204/483; 204/508; 204/623; 204/280; 101/DIG. 29

(58) Field of Search ..... 204/486, 483, 204/508, 623, 280; 101/DIG. 29

(56) References Cited

U.S. PATENT DOCUMENTS 4,661,222 4/1987 Castegnier ..... 204/180.9
4,895,629 1/1990 Castegnier et al. ..... 204/180.9
5,538,601 7/1996 Castegnier ..... 204/486
5,750,593 5/1998 Castegnier et al. ..... 523/161
5,908,541 6/1999 Castegnier ..... 204/486

*Primary Examiner*—Kishor Mayekar
(74) *Attorney, Agent, or Firm*—Ogilvy Renault

(57) ABSTRACT

An anode having a passive oxide film thereon and made of an iron alloy consisting essentially of at least 20 wt. % Cr, 5 to 15 wt. % Ni, 1 to 2 wt. % Si, 0.9 to 1.5 wt. % Mn and 0.1 to 0.3 wt. % C with the balance consisting of iron and unavoidable impurities is used for reproducing an image by electrocoagulation of a colloid. Such an anode can be thoroughly cleaned without undergoing abrasion and/or pitting during cleaning. The alloy composition does not adversely affect passivation.

50 Claims, No Drawings

STAINLESS STEEL ANODE FOR ELECTROCOAGULATION PRINTING

BACKGROUND OF THE INVENTION

The present invention pertains to improvements in the field of electrocoagulation printing. More particularly, the invention relates to an improved anode for use in an electrocoagulation printing method and apparatus.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is thereafter cleaned by means of a plurality of rotating brushes and a cleaning liquid to remove any residual coagulated colloid adhered to the surface of the positive electrode.

When a polychromic image is desired, the negative and positive electrodes, the positive electrode coating device, ink injector, rubber squeegee and positive electrode cleaning device are arranged to define a printing unit and several printing units each using a coloring agent of different color are disposed in tandem relation to produce several differently colored images of coagulated colloid which are transferred at respective transfer stations onto the substrate in superimposed relation to provide the desired polychromic image. Alternatively, the printing units can be arranged around a single roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

The positive electrode which is used for electrocoagulation printing must be made of an electrolytically inert metal capable of releasing trivalent ions so that upon electrical energization of the negative electrodes, dissolution of the passive oxide film on such an electrode generates trivalent ions which then initiate coagulation of the colloid. Examples of suitable electrolytically inert metals include stainless steels, aluminium and tin.

As explained in Applicant's U.S. Pat. No. 5,750,593 of May 12, 1998, the teaching of which is incorporated herein by reference, a breakdown of passive oxide films occurs in the presence of electrolyte anions, such as $Cl^-$, $Br^-$ and $I^-$, there being a gradual oxygen displacement from the passive film by the halide anions and a displacement of adsorbed oxygen from the metal surface by the halide anions. The velocity of passive film breakdown, once started, increases explosively in the presence of an applied electric field. There is thus formation of a soluble metal halide at the metal surface. In other words, a local dissolution of the passive oxide film occurs at the breakdown sites, which releases metal ions into the electrolyte solution. Where a positive electrode made of stainless steel or aluminium is utilized in Applicant's electrocoagulation printing method, dissolution of the passive oxide film on such an electrode generates $Fe^{3+}$ or $Al^{3+}$ ions. These trivalent ions then initiate coagulation of the colloid.

Stainless steels are preferred due to their low cost and availability. These are iron alloys containing a minimum of approximately 11 wt. % chromium. This amount of chromium prevents the formation of rust in unpoluted atmospheres. Their corrosion resistance is provided by the aforesaid passive oxide film which is self-healing in a wide variety of environments.

The stainless steels hitherto used by the Applicant consisted of 12 to 20 wt. % Cr, 3 to 10 wt. % Ni, 0.5 to 2.5 wt. % Mo and 0.03 to 0.09 wt. % C, with the balance consisting of iron and unavoidable impurities. Although such alloys give satisfactory results in respect of electrocoagulation, Applicant has observed that they do not have a hardness sufficient to withstand the harsh conditions encountered during cleaning of the positive electrode, resulting in abrasion and pitting of such an electrode. It is therefore necessary to regrind the surface of the electrode after every forty hours of printing. This, of course, requires shutdown of the printing apparatus and removal of the electrode.

As it is known, many elements other than chromium are added to iron to provide specific properties or ease of fabrication. For example, nickel, nitrogen and molybdenum are added for corrosion resistance; carbon, nitrogen and titanium for strength; sulfur and selenium for machinability and nickel for formability and toughness. Applicant has observed that a stainless steel with a high carbon content adversely affects passivation. A stainless steel with a high nickel content, on the other hand, is difficult to clean so that a residual film of ink containing non-coagulated colloid is left on the surface of the positive electrode and is transferred with the colored, coagulated colloid onto the substrate during contacting same. Thus, when black, cyan, magenta and yellow coloring agents are used to provide a polychromic image, the residual films containing these coloring agents upon being transferred onto the substrate in superimposed relation create on the printed image an undesirable colored background.

SUMMARY OF THE INVENTION

It is therefore an object of the present invention to overcome the above drawbacks and to provide an improved stainless steel anode for use in an electrocoagulation printing method and apparatus, that can be thoroughly cleaned without undergoing abrasion and/or pitting during cleaning and has an alloy composition which does not adversely affect passivation.

According to one aspect of the invention, there is provided an improved electrocoagulation printing method comprising the steps of:

a) providing a positive electrolytically inert electrode having a continuous passivated surface moving at substantially constant speed along a predetermined path, the passivated surface defining a positive electrode active surface;

b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and c) bringing a substrate into contact with the dots of colored, coagulated colloid to cause transfer of the colored, coagulated colloid from the positive electrode active surface onto the substrate and thereby imprint the substrate with the image;

the improvement wherein the positive electrode is made of an iron alloy consisting essentially of:

Cr: at least 20 wt. %

Ni: 5 to 15 wt. %

Si: 1 to 2 wt. %

Mn: 0.9 to 1.5 wt. %

C: 0.1 to 0.3 wt. % balance: iron and unavoidable impurities.

According to another aspect of the invention, there is also provided an improved electrocoagulation printing apparatus comprising:

a positive electrolytically inert electrode having a continuous passivated surface defining a positive electrode active surface;

means for moving the positive electrode active surface at a substantially constant speed along a predetermined path;

means for forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and means for bringing a substrate into contact with the dots of colored, coagulated colloid to cause transfer of the colored, coagulated colloid from the positive electrode active surface onto the substrate and thereby imprint the substrate with the image;

the improvement wherein the positive electrode is made of an iron alloy consisting essentially of:

Cr: at least 20 wt. %

Ni: 5 to 15 wt. %

Si: 1 to 2 wt. %

Mn: 0.9 to 1.5 wt. %

C: 0.1 to 0.3 wt. % balance: iron and unavoidable impurities.

Applicant has found quite unexpectedly that a stainless steel anode with the above alloy composition is sufficiently hard so that it can be thoroughly cleaned without undergoing abrasion and/or pitting during cleaning and that such an alloy composition does not adversely affect passivation. The stainless steel must have a chromium content of at least 20 wt. % since, when the chromium content is lower than 20 wt. %, the passive oxide film does not have sufficiently rapid self-healing properties and there is a release of undesirable $Fe^{+2}$ ions. A chromium content ranging between 20 and 30 wt. % is preferred. The stainless steel must also have a nickel content within the range of 5 to 15 wt. % since, when the nickel content is higher than 15 wt. %, the anode cannot be thoroughly cleaned so that a residual film of ink containing non-coagulated colloid is left on the surface of the anode, leading to the formation of undesirable background on the printed image. On the other hand, when the nickel content is lower than 5 wt. %, the steel is not sufficiently ductile and corrosion-resistant. A carbon content within the range of 0.1 to 0.3 wt. % is essential since, when the carbon content is higher than 0.3 wt. %, passivation is adversely affected and, when the carbon content is lower than 0.1 wt. %, the steel is not sufficiently hard. Manganese is an alloying agent added for providing depassivation initiation sites, whereas silicon is an alloying agent added for increasing the resistance to chloride corrosion.

Where a polychromic image is desired, steps (b) and (c) of the above electrocoagulation printing method are repeated several times to define a corresponding number of printing stages arranged at predetermined locations along the aforesaid path and each using a coloring agent of different color, and to thereby produce several differently colored images of coagulated colloid which are transferred at the respective transfer positions onto the substrate in superimposed relation to provide a polychromic image. It is also possible to repeat several times steps (a), (b) and (c) to define a corresponding number of printing stages arranged in tandem relation and each using a coloring agent of different color, and to thereby produce several differently colored images of coagulated colloid which are transferred at respective transfer positions onto the substrate in superimposed relation to provide a polychromic image, the substrate being in the form of a continuous web which is passed through the respective transfer positions for being imprinted with the colored images at the printing stages. Alternatively, the printing stages defined by repeating several times steps (a), (b) and (c) can be arranged around a single roller adapted to bring the substrate into contact with the dots of colored, coagulated colloid of each printing stage and the substrate which is in the form of a continuous web is partially wrapped around the roller and passed through the respective transfer positions for being imprinted with the colored images at the printing stages. The last two arrangements are described in Applicant's U.S. Pat. No. 4,895,629.

When a polychromic image of high definition is desired, it is preferable to bring an endless non-extensible belt moving at substantially the same speed as the positive electrode active surface and having on one side thereof a colloid retaining surface adapted to releasably retain dots of electrocoagulated colloid to cause transfer of the differently colored images at the respective transfer positions onto the colloid retaining surface of such a belt in superimposed relation to provide a polychromic image, and thereafter bring the substrate into contact with the colloid retaining surface of the belt to cause transfer of the polychromic image from the colloid retaining surface onto the substrate and to thereby imprint the substrate with the polychromic image. As explained in Applicant's U.S. Pat. No. 5,908,541 of Jun. 1, 1999, the teaching of which is incorporated herein by reference, by utilizing an endless non-extensible belt having a colloid retaining surface such as a porous surface on which dots of colored, coagulated colloid can be transferred and by moving such a belt independently of the positive electrode, from one printing unit to another, so that the colloid retaining surface of the belt contacts the colored, coagulated colloid in sequence, it is possible to significantly improve the registration of the differently colored images upon their transfer onto the colloid retaining surface of the belt, thereby providing a polychromic image of high definition which can thereafter be transferred onto the paper web or other substrate. For example, use can be made of a belt comprising a plastic material having a porous coating of silica.

Accordingly, the present invention also provides, in a further aspect thereof, an improved multicolor electrocoagulation printing method comprising the steps of:

a) providing a positive electrolytically inert electrode having a continuous passivated surface moving at substantially constant speed along a predetermined path, the passivated surface defining a positive electrode active surface;

b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent;

c) bringing an endless non-extensible belt having a porous surface on one side thereof and moving at substantially the same speed as the positive electrode, into contact with the positive electrode active surface to cause transfer of the dots of colored, coagulated colloid from the positive electrode active surface onto the porous surface of the belt and to thereby imprint the porous surface with the image;

d) repeating steps (b) and (c) several times to define a corresponding number of printing stages arranged at predetermined locations along the path and each using a coloring agent of different color, to thereby produce several differently colored images of coagulated colloid which are transferred at respective transfer positions onto the porous surface in superimposed relation to provide a polychromic image; and e) bringing a substrate into contact with the porous surface of the belt to cause transfer of the polychromic image from the porous surface onto the substrate and to thereby imprint the substrate with the polychromic image; the improvement wherein the positive electrode is made of an iron alloy consisting essentially of:

Cr: at least 20 wt. %

Ni: 5 to 15 wt. %

Si: 1 to 2 wt. %

Mn: 0.9 to 1.5 wt. %

C: 0.1 to 0.3 wt. % balance: iron and unavoidable impurities.

According to yet another aspect of the invention, there is provided an improved electrocoagulation printing apparatus comprising:

a positive electrolytically inert electrode having a continuous passivated surface defining a positive electrode active surface;

means for moving the positive electrode active surface at a substantially constant speed along a predetermined path;

an endless non-extensible belt having a porous surface on one side thereof;

means for moving the belt at substantially the same speed as the positive electrode;

a plurality of printing units arranged at predetermined locations along the path, each printing unit comprising:

means for forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersion medium, a soluble electrolyte and a coloring agent, and means for bringing the belt into contact with the positive electrode active surface at a respective transfer station to cause transfer of the dots of colored, coagulated colloid from the positive electrode active surface onto the porous surface of the belt and to imprint the porous surface with the image, thereby producing several differently colored images of coagulated colloid which are transferred at the respective transfer stations onto the porous surface in superimposed relation to provide a polychromic image; and means for bringing a substrate into contact with the porous surface of the belt to cause transfer of the polychromic image from the porous surface onto the substrate and to thereby imprint the substrate with the polychromic image;

the improvement wherein said electrode is made of an iron alloy consisting essentially of:

Cr: at least 20 wt. %

Ni: 5 to 15 wt. %

Si: 1 to 2 wt. %

Mn: 0.9 to 1.5 wt. %

C: 0.1 to 0.3 wt. % balance: iron and unavoidable impurities.

DESCRIPTION OF PREFERRED EMBODIMENTS

Use is preferably made of an iron alloy consisting essentially of 25 to 28 wt. % Cr, 8 to 11 wt. % Ni, 1 to 2 wt. % Si, 0.9 to 1.5 wt. % Mn and 0.1 to 0.2 wt. % C, the balance consisting of iron and unavoidable impurities. A particularly preferred iron alloy consists essentially of 26.4 wt. % Cr, 9.7 wt. % Ni, 1.08 wt. % Si, 0.95 wt. % Mn and 0.12 wt. % C, the balance consisting of iron and unavoidable impurities. Such an alloy has a Brinell hardness of about 225. It is possible to increase the Brinell hardness of this alloy up to about 325, without adversely affecting passivation, by subjecting the alloy after casting to a heat treatment at a temperature of about 1120° C. (2050° F.) and to a subsequent water quenching. The alloy thus treated has an austenitic-ferritic structure.

The positive electrode used can be in the form of a moving endless belt as described in Applicant's U.S. Pat. No. 4,661,222, or in the form of a revolving cylinder as described in Applicant's U.S. Pat. Nos. 4,895,629 and 5,538,601, the teachings of which are incorporated herein by reference. In the later case, the printing stages or units are arranged around the positive cylindrical electrode. Preferably, the positive electrode active surface and the ink are maintained at a temperature of about 35–60° C., preferably 40° C., to increase the viscosity of the coagulated colloid in step (b) so that the dots of colored, coagulated colloid remain coherent during their transfer in step (c), thereby enhancing transfer of the colored, coagulated colloid onto the substrate or belt. For example, the positive electrode active surface can be heated at the desired temperature and the ink applied on the heated electrode surface to cause a transfer of heat therefrom to the ink.

When use is made of a positive electrode of cylindrical configuration rotating at substantially constant speed about its central longitudinal axis, step (b) of the above electrocoagulation printing method is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of the positive electrode and spaced from the positive electrode active surface by a constant predetermined gap, the negative electrodes being spaced from one another by a distance at least equal to the electrode gap;

ii) coating the positive electrode active surface with an olefinic substance to form on the surface micro-droplets of olefinic substance;

iii) filling the electrode gap with the aforesaid electrocoagulation printing ink;

iv) electrically energizing selected ones of the negative electrodes to cause point-by-point selective coagulation and adherence of the colloid onto the olefin coated positive electrode active surface opposite the electrode active surfaces of the energized negative electrodes while the positive electrode is rotating, thereby forming the dots of colored, coagulated colloid; and v) removing any remaining non-coagulated colloid from the positive electrode active surface.

As explained in U.S. Pat. No. 4,895,629, spacing of the negative electrodes from one another by a distance which is equal to or greater than the electrode gap prevents the negative electrodes from undergoing edge corrosion. On the other hand, coating of the positive electrode with an olefinic substance prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes. Applicant has found that it is no longer necessary to admix a metal oxide with the olefin substance; it is believed that the passive oxide film on currently available electrodes contains sufficient metal oxide to act as catalyst for the desired reaction.

Examples of suitable electrolytically inert metals from which the positive and negative electrodes can be made are stainless steel, platinum, chromium, nickel and aluminum. The gap which is defined between the positive and negative electrodes can range from about 50$\mu$ to about 100$\mu$, the smaller the electrode gap the sharper are the dots of coagulated colloid produced. Where the electrode gap is of the order of 50$\mu$, the negative electrodes are the preferably spaced from one another by a distance of about 75$\mu$.

Examples of suitable olefinic substances which may be used to coat the surface of the positive electrode in step (b)(ii) include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. Oleic acid is particularly preferred. The micro-droplets of olefinic substance formed on the surface of the positive electrode active surface generally have a size ranging from about 1 to about 5$\mu$.

The olefin-coated positive active surface is preferably polished to increase the adherence of the micro-droplets onto the positive electrode active surface, prior to step (b)(ii). For example, use can be made of a rotating brush provided with a plurality of radially extending bristles made of horsehair and having extremities contacting the surface of the positive electrode. The friction caused by the bristles contacting the surface upon rotation of the brush has been found to increase the adherence of the micro-droplets onto the positive electrode active surface.

Where the positive cylindrical electrode extends vertically, step (b)(ii) of the above electrocoagulation printing method is advantageously carried out by continuously discharging the ink onto the positive electrode active surface from a fluid discharge means disposed adjacent the electrode gap at a predetermined height relative to the positive electrode and allowing the ink to flow downwardly along the positive electrode active surface, the ink being thus carried by the positive electrode upon rotation thereof to the electrode gap to fill same. Preferably, excess ink flowing downwardly off the positive electrode active surface is collected and the collected ink is recirculated back to the fluid discharge means.

The colloid generally used is a linear colloid of high molecular weight, that is, one having a weight average molecular weight between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a weight average molecular weight of about 250,000 and sold by Cyanamid Inc. under the trade mark ACCOSTRENGTH 86. Water is preferably used as the medium for dispersing the colloid to provide the desired colloidal dispersion.

The ink also contains a soluble electrolyte and a coloring agent. Preferred electrolytes include alkali metal halides and alkaline earth metal halides, such as lithium chloride, sodium chloride, potassium chloride and calcium chloride. Potassium chloride is particularly preferred. The coloring agent can be a dye or a pigment. Examples of suitable dyes which may be used to color the colloid are the water soluble dyes available from HOECHST such a Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the ink. Examples of suitable dispersing agents include the anionic dispersing agent sold by Boehme Filatex Canada Inc. under the trade mark CLOSPERSE 25000.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected ink, and the collected non-coagulated colloid in admixture with the collected ink is recirculated back to the aforesaid fluid discharge means.

The optical density of the dots of colored, coagulated colloid may be varied by varying the voltage and/or pulse duration of the pulse-modulated signals applied to the negative electrodes.

After step (c), the positive electrode active surface is generally cleaned to remove therefrom any remaining coagulated colloid. According to a preferred embodiment, the positive electrode is rotatable in a predetermined direction and any remaining coagulated colloid is removed from the positive electrode active surface by providing an elongated rotatable brush extending parallel to the longitudinal axis of the positive electrode, the brush being provided with a plurality of radially extending bristles made of horsehair and having extremities contacting the positive electrode active surface, rotating the brush in a direction opposite to the direction of rotation of the positive electrode so as to cause the bristles to frictionally engage the positive electrode active surface, and directing jets of cleaning liquid under pressure against the positive electrode active surface, from either side of the brush. In such an embodiment, the positive electrode active surface and the ink are preferably maintained at a temperature of about 35–60° C. by heating the cleaning liquid to thereby heat the positive electrode active surface upon contacting same and applying the ink on the heated electrode surface to cause a transfer of heat therefrom to the ink.

Preferably, the electrocoagulation printing ink contains water as the dispersing medium and the dots of differently colored, coagulated colloid representative of the polychromic image are moistened between the aforementioned steps (d) and (e) so that the polychromic image is substantially completely transferred onto the substrate in step (e).

According to another preferred embodiment, the substrate is in the form of a continuous web and step (e) is carried out by providing a support roller and a pressure roller extending parallel to the support roller and pressed thereagainst to form a nip through which the belt is passed, the support roller and pressure roller being driven by the belt upon movement thereof, and guiding the web so as to pass through the nip between the pressure roller and the porous surface of the belt for imprinting the web with the polychromic image. Preferably, the belt with the porous surface thereof imprinted with the polychromic image is guided so as to travel along a path extending in a plane intersecting the longitudinal axis of the positive electrode at right angles, thereby exposing the porous surface to permit contacting thereof by the web. Where the longitudinal axis of the positive electrode extends vertically, the belt is preferably guided so as to travel along a horizontal path with the porous surface facing downwardly, the support roller and pressure roller having rotation axes disposed in a plane extending perpendicular to the horizontal path. Such an arrangement is described in the aforementioned U.S. Pat. No. 5,908,541.

After step (e), the porous surface of the belt is generally cleaned to remove therefrom any remaining coagulated colloid. According to a preferred embodiment, any remaining coagulated colloid is removed from the porous surface of the belt by providing at least one elongated rotatable brush disposed on the one side of the belt and at least one support roller extending parallel to the brush and disposed on the opposite side of the belt, the brush and support roller having rotation axes disposed in a plane extending perpendicular to the belt, the brush being provided with a plurality of radially extending bristles made of horsehair and having extremities contacting the porous surface, rotating the brush in a direction opposite to the direction of movement of the belt so as to cause the bristles to frictionally engage the porous surface while supporting the belt with the support roller, directing jets of cleaning liquid under pressure against the porous surface from either side of the brush and removing the cleaning liquid with any dislodged coagulated colloid from the porous surface.

I claim:

1. In an electrocoagulation printing method comprising the steps of:

a) providing a positive electrolytically inert electrode having a continuous passivated surface moving at substantially constant speed along a predetermined path, said passivated surface defining a positive electrode active surface;

b) forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and c) bringing a substrate into contact with the dots of colored, coagulated colloid to cause transfer of the colored, coagulated colloid from the positive electrode active surface onto said substrate and thereby imprint said substrate with said image;

the improvement wherein said positive electrode is made of an iron alloy consisting essentially of:

Cr: at least 20 wt. %

Ni: 5 to 15 wt. %

Si: 1 to 2 wt. %

Mn: 0.9 to 1.5 wt. %

C: 0.1 to 0.3 wt. % balance: iron and unavoidable impurities.

2. A method as claimed in claim 1, wherein said iron alloy contains 20 to 30 wt. % of chromium.

3. A method as claimed in claim 2, wherein said iron alloy consists essentially of:

Cr: 25 to 28 wt. %

Ni: 8 to 11 wt. %

Si: 1 to 2 wt. %

Mn: 0.9 to 1.5 wt. %

C: 0.1 to 0.2 wt. % balance: iron and unavoidable impurities.

4. A method as claimed in claim 3, wherein said iron alloy consists essentially of:

Cr: 26.4 wt. %

Ni: 9.7 wt. %

Si: 1.08 wt. %

Mn: 0.95 wt. %

C: 0.12 wt. % balance: iron and unavoidable impurities.

5. A method as claimed in claim 4, wherein said iron alloy is a cast alloy which has been subjected after casting to a heat treatment at a temperature of about 1120° C. and to a subsequent water quenching.

6. A method as claimed in claim 5, wherein said cast alloy has an austenitic-ferritic structure.

7. A method as claimed in claim 1, wherein steps (b) and (c) are repeated several times to define a corresponding number of printing stages arranged at predetermined locations along said path and each using a coloring agent of different color, to thereby produce several differently colored images of coagulated colloid which are transferred at respective transfer positions onto said substrate in superimposed relation to provide a polychromic image.

8. A method as claimed in claim 7, wherein said positive electrode is a cylindrical electrode having a central longitudinal axis and rotating at substantially constant speed about said longitudinal axis, and wherein said printing stages are arranged around said positive cylindrical electrode.

9. A method as claimed in claim 8, wherein said iron alloy contains 20 to 30 wt. % of chromium.

10. A method as claimed in claim 9, wherein said iron alloy consists essentially of:

Cr: 25 to 28 wt. %

Ni: 8 to 11 wt. %

Si: 1 to 2 wt. %

Mn: 0.9 to 1.5 wt. %

C: 0.1 to 0.2 wt. % balance: iron and unavoidable impurities.

11. A method as claimed in claim 10, wherein said iron alloy consists essentially of:

Cr: 26.4 wt. %

Ni: 9.7 wt. %

Si: 1.08 wt. %

Mn: 0.95 wt. %

C: 0.12 wt. % balance: iron and unavoidable impurities.

12. A method as claimed in claim 11, wherein said iron alloy is a cast alloy which has been subjected after casting to a heat treatment at a temperature of about 1120° C. and to a subsequent water quenching.

13. A method as claimed in claim 12, wherein said cast alloy has an austenitic-ferritic structure.

14. In a multicolor electrocoagulation printing method comprising the steps of:

a) providing a positive electrolytically inert electrode having a continuous passivated surface moving at substantially constant speed along a predetermined path, said passivated surface defining a positive electrode active surface;

b) forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent;

c) bringing an endless non-extensible belt having a porous surface on one side thereof and moving at substantially the same speed as said positive electrode, into contact with said positive electrode active surface to cause transfer of the dots of colored, coagulated colloid from the positive electrode active surface onto the porous surface of said belt and to thereby imprint said porous surface with the image;

d) repeating steps (b) and (c) several times to define a corresponding number of printing stages arranged at predetermined locations along said path and each using a coloring agent of different color, to thereby produce several differently colored images of coagulated colloid which are transferred at respective transfer positions onto said porous surface in superimposed relation to provide a polychromic image; and e) bringing a substrate into contact with the porous surface of said belt to cause transfer of the polychromic image from said porous surface onto said substrate and to thereby imprint said substrate with said polychromic image;

the improvement wherein said positive electrode is made of an iron alloy consisting essentially of:

Cr: 20 to 30 wt. %

Ni: 5 to 15 wt. %

Si: 1 to 2 wt. %

Mn: 0.9 to 1.5 wt. %

C: 0.1 to 0.3 wt. % balance: iron and unavoidable impurities.

15. A method as claimed in claim 14, wherein said iron alloy contains 20 to 30 wt. % of chromium.

16. A method as claimed in claim 15, wherein said iron alloy consists essentially of:

Cr: 25 to 28 wt. %

Ni: 8 to 11 wt. %

Si: 1 to 2 wt. %

Mn: 0.9 to 1.5 wt. %

C: 0.1 to 0.2 wt. % balance: iron and unavoidable impurities.

17. A method as claimed in claim 16, wherein said iron alloy consists essentially of:

Cr: 26.4 wt. %

Ni: 9.7 wt. %

Si: 1.08 wt. %

Mn: 0.95 wt. %

C: 0.12 wt. % balance: iron and unavoidable impurities.

18. A method as claimed in claim 17, wherein said iron alloy is a cast alloy which has been subjected after casting to a heat treatment at a temperature of about 1122° C. and to a subsequent water quenching.

19. A method as claimed in claim 18, wherein said cast alloy has an austenitic-ferritic structure.

20. A method as claimed in claim 15, wherein said positive electrode is a cylindrical electrode having a central longitudinal axis and rotating at substantially constant speed about said longitudinal axis, and wherein said printing stages are arranged around said positive cylindrical electrode.

21. A method as claimed in claim 20, wherein said iron alloy contains 20 to 30 wt. % of chromium.

22. A method as claimed in claim 21, wherein said iron alloy consists essentially of:

Cr: 25 to 28 wt. %

Ni: 8 to 11 wt. %

Si: 1 to 2 wt. %

Mn: 0.9 to 1.5 wt. %

C: 0.1 to 0.2 wt. % balance: iron and unavoidable impurities.

23. A method as claimed in claim 22, wherein said iron alloy consists essentially of:

Cr: 26.4 wt. %

Ni: 9.7 wt. %

Si: 1.08 wt. %

Mn: 0.4 wt. %

C: 0.12 wt. % balance: iron and unavoidable impurities.

24. A method as claimed in claim 23, wherein said iron alloy is a cast alloy which has been subjected after casting a heat treatment at a temperature of about 1122° C. and to a subsequent water quenching.

25. A method as claimed in claim 24, wherein said cast alloy has an austenitic-ferritic structure.

26. In an electrocoagulation printing apparatus comprising:

a positive electrolytically inert electrode having a continuous passivated surface defining a positive electrode active surface;

means for moving said positive electrode active surface at a substantially constant speed along a predetermined path;

means for forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and means for bringing a substrate into contact with the dots of colored, coagulated colloid to cause transfer of the colored, coagulated colloid from the positive electrode active surface onto said substrate and thereby imprint said substrate with said image;

the improvement wherein said positive electrode is made of an iron alloy consisting essentially of:

Cr: at least 20 wt. %

Ni: 5 to 15 wt. %

Si: 1 to 2 wt. %

Mn: 0.9 to 1.5 wt. %

C: 0.1 to 0.3 wt. % balance: iron and unavoidable impurities.

27. An apparatus as claimed in claim 26, wherein said iron alloy contains 20 to 30 wt. % of chromium.

28. An apparatus as claimed in claim 27, wherein said iron alloy consists essentially of:

Cr: 25 to 28 wt. %

Ni: 8 to 11 wt. %

Si: 1 to 2 wt. %

Mn: 0.9 to 1.5 wt. %

C: 0.1 to 0.2 wt. % balance: iron and unavoidable impurities.

29. An apparatus as claimed in claim 28, wherein said iron alloy consists essentially of:

Cr: 26.4 wt. %

Ni: 9.7 wt. %

Si: 1.08 wt. %

Mn: 0.95 wt. %

C: 0.12 wt. % balance: iron and unavoidable impurities.

30. An apparatus as claimed in claim 29, wherein said iron alloy is a cast alloy which has been subjected after casting to a heat treatment at a temperature of about 1122° C. and to a subsequent water quenching.

31. An apparatus as claimed in claim 30, wherein said cast alloy has an austenitic-ferritic structure.

32. An apparatus as claimed in claim 26, wherein said means for forming said dots of colored, coagulated colloid and said means for bringing said substrate into contact with said dots of colored, coagulated colloid are arranged to define a printing unit, and wherein there are several printing units positioned at predetermined locations along said path and each using a coloring agent of different colored for producing several differently colored images of coagulated colloid which are transferred at respective transfer stations onto said substrate in superimposed relation to provide a polychromic image.

33. An apparatus as claimed in claim 32, wherein said positive electrode is a cylindrical electrode having a central longitudinal axis and rotating at substantially constant speed about said longitudinal axis, and wherein said printing units are arranged around said positive cylindrical electrode.

34. An apparatus as claimed in claim 33, wherein said iron alloy contains 20 to 30 wt. % of chromium.

35. An apparatus as claimed in claim 34, wherein said iron alloy consists essentially of:

Cr: 25 to 28 wt. %

Ni: 8 to 11 wt. %

Si: 1 to 2 wt. %

Mn: 0.9 to 1.5 wt. %

C: 0.1 to 0.2 wt. % balance: iron and unavoidable impurities.

36. An apparatus as claimed in claim 35, wherein said iron alloy consists essentially of:

Cr: 26.4 wt. %

Ni: 9.7 wt. %

Si: 1.08 wt. %

Mn: 0.95 wt. %

C: 0.12 wt. % balance: iron and unavoidable impurities.

37. An apparatus as claimed in claim 36, wherein said iron alloy is a cast alloy which has been subjected after casting to a heat treatment at a temperature of about 1122° C. and to a subsequent water quenching.

38. An apparatus as claimed in claim 37, wherein said cast alloy has an austenitic-ferritic structure.

39. In a multicolor electrocoagulation printing apparatus comprising:

a positive electrolytically inert electrode having a continuous passivated surface defining a positive electrode active surface;

means for moving said positive electrode active surface at a substantially constant speed along a predetermined path;

an endless non-extensible belt having a porous surface on one side thereof;

means for moving said belt at substantially the same speed as said positive electrode;

a plurality of printing units arranged at predetermined locations along said path, each printing unit comprising:

means for forming on said positive electrode active surface a plurality of dots of colored, coagulated colloid representative of a desired image, by electrocoagulated of an electrolytically coagulable colloid present in an electrocoagulation printing ink comprising a liquid colloidal dispersion containing said electrolytically coagulable colloid, a dispersion medium, a soluble electrolyte and a coloring agent, and means for bringing said belt into contact with said positive electrode active surface at a respective transfer station to cause transfer of the dots of colored, coagulated colloid from the positive electrode active surface onto the porous surface of said belt and to imprint said porous surface with the image, thereby producing several differently colored images of coagulated colloid which are transferred at said respective transfer stations onto said porous surface in superimposed relation to provide a polychromic image; and means for bringing a substrate into contact with the porous surface of said belt to cause transfer of the polychromic image from said porous surface onto said substrate and to thereby imprint said substrate with said polychromic image;

the improvement wherein said positive electrode is made of an iron alloy consisting essentially of:

Cr: at least 20 wt. %

Ni: 5 to 15 wt. %

Si: 1 to 2 wt. %

Mn: 0.9 to 1.5 wt. %

C: 0.1 to 0.3 wt. % balance: iron and unavoidable impurities.

40. An apparatus as claimed in claim 39, wherein said iron alloy contains 20 to 30 wt. % of chromium.

41. An apparatus as claimed in claim 40, wherein said iron alloy consists essentially of:

Cr: 25 to 28 wt. %

Ni: 8 to 11 wt. %

Si: 1 to 2 wt. %

Mn: 0.9 to 1.5 wt. %

C: 0.1 to 0.2 wt. % balance: iron and unavoidable impurities.

42. An apparatus as claimed in claim 41, wherein said iron alloy consists essentially of:

Cr: 26.4 wt. %

Ni: 9.7 wt. %

Si: 1.08 wt. %

Mn: 0.95 wt. %

C: 0.12 wt. % balance: iron and unavoidable impurities.

43. An apparatus as claimed in claim 42, wherein said iron alloy is a cast alloy which has been subjected after casting to a heat treatment at a temperature of about 1122° C. and to a subsequent water quenching.

44. An apparatus as claimed in claim 43, wherein said cast alloy has an austenitic-ferritic structure.

45. An apparatus as claimed in claim 39, wherein said positive electrode is a cylindrical electrode having a central longitudinal axis and wherein said means for moving said positive electrode active surface includes means for rotating said positive cylindrical electrode about said longitudinal axis, said printing units being arranged around said positive cylindrical electrode.

46. An apparatus as claimed in claim 45, wherein said iron alloy contains 20 to 30 wt. % of chromium.

47. An apparatus as claimed in claim 46, wherein said iron alloy consists essentially of:

Cr: 25 to 28 wt. %

Ni: 8 to 11 wt. %

Si: 1 to 2 wt. %

Mn: 0.9 to 1.5 wt. %

C: 0.1 to 0.2 wt. % balance: iron and unavoidable impurities.

48. An apparatus as claimed in claim 47, wherein said iron alloy consists essentially of:

Cr: 26.4 wt. %

Ni: 9.7 wt. %

Si: 1.08 wt. %

Mn: 0.95 wt. %

C: 0.12 wt. % balance: iron and unavoidable impurities.

49. An apparatus as claimed in claim 48, wherein said iron alloy is a cast alloy which has been subjected after casting to a heat treatment at a temperature of about 1122° C. and to a subsequent water quenching.

50. An apparatus as claimed in claim 49, wherein said cast alloy has an austenitic-ferritic structure.

* * * * *